US009675190B1

(12) United States Patent
Douglas et al.

(10) Patent No.: US 9,675,190 B1
(45) Date of Patent: Jun. 13, 2017

(54) COMBINED PLATE AND COLLAPSIBLE BEVERAGE HOLDER

(71) Applicant: COGENT TECHNOLOGY CORPORATION, Austin, TX (US)

(72) Inventors: David W. Douglas, Austin, TX (US); Robert R. Durkee, III, Austin, TX (US)

(73) Assignee: COGENT TECHNOLOGY CORPORATION, Austin, TX (US)

( * ) Notice: Subject to any disclaimer, the term of this patent is extended or adjusted under 35 U.S.C. 154(b) by 0 days.

(21) Appl. No.: 15/359,083

(22) Filed: Nov. 22, 2016

Related U.S. Application Data

(60) Provisional application No. 62/263,436, filed on Dec. 4, 2015.

(51) Int. Cl.
*A47G 19/06* (2006.01)

(52) U.S. Cl.
CPC ..... *A47G 19/06* (2013.01)

(58) Field of Classification Search
CPC ..... A47G 19/06; A47G 23/0633; B65D 1/36; B65D 11/18
USPC ..... 206/216, 562–565, 557
See application file for complete search history.

(56) References Cited

U.S. PATENT DOCUMENTS

| | | | | |
|---|---|---|---|---|
| 3,955,672 | A * | 5/1976 | Brundage | A47G 19/065 206/218 |
| 5,697,512 | A | 12/1997 | Brickley | |
| 6,185,860 | B1 * | 2/2001 | Thibodeaux | A01K 97/06 206/315.11 |
| 2006/0266748 | A1 | 11/2006 | Crawford | |
| 2011/0303659 | A1 * | 12/2011 | Perlman | A45F 3/20 220/8 |
| 2012/0074188 | A1 * | 3/2012 | Andersson | B60N 2/4613 224/539 |

* cited by examiner

*Primary Examiner* — Anthony Stashick
*Assistant Examiner* — Raven Collins
(74) *Attorney, Agent, or Firm* — Howison & Arnott, LLP

(57) ABSTRACT

An apparatus comprises a plate defining a surface for holding food that defines at least one opening therein. A collapsible beverage holder fits within the at least one opening defined within the surface of the plate. The collapsible beverage holder is automatically configured to a collapsed configuration responsive to the apparatus being placed on a surface and is automatically configured to an un-collapsed configuration responsive to the apparatus being lifted off the surface by the plate.

21 Claims, 7 Drawing Sheets

COMBINED PLATE AND COLLAPSIBLE BEVERAGE HOLDER

CROSS-REFERENCE TO RELATED APPLICATIONS

This application claims priority to U.S. Provisional Patent Application No. 62/263,436, filed on Dec. 4, 2015, entitled COMBINED PLATE AND COLLAPSIBLE BEVERAGE HOLDER, which is incorporated herein by reference in its entirety.

TECHNICAL FIELD

The present invention relates to plates, and more particularly, to plates including an integrated beverage container holder.

BACKGROUND

At many parties and events where food and beverages are served, there may be insufficient tables and chairs to accommodate all invited guests. In these cases, guests are usually tasked with holding a plate of food and a beverage while standing and attempting to eat the food and drink the beverage with only two hands. This typically results in an almost impossible balancing task or having to find a place to set down the beverage in order to eat the food. Napkins and eating utensils also contribute to this common party dilemma experienced by almost everyone.

Numerous efforts have been made toward solving this dilemma by combining a plate with a means for holding the beverage. Each of these efforts have various shortcomings that provide particular limitations for the combined plate and beverage holder. These shortcomings have usually involved the design and location of the beverage holder in relation to the plate and resulted in two basic solutions. First, if the bottom of the beverage container sits at the level of the plate to allow the apparatus to sit flat on a table, the center of gravity of the beverage container extends far above the plate, and, if not securely held by the beverage holder extending considerably above the surface of the plate, is unstable and prone to tipping and spilling. The large difference in various diameters of beverage containers further exacerbates this problem of securely holding the beverage container in an upright fashion. Second, if the bottom of the beverage container sits below the level of the plate to solve the tipping and spilling problem noted above, the plate must have legs or other means of elevation to raise it so that the plate and beverage holder can be placed on the table without tilting the plate and spilling the beverage within the beverage holder.

Each of these two solutions significantly increase the space required for the integrated plate and beverage holder in a cabinet, drawer, or dishwasher because of the extension of the beverage holder above or below the plate. Additionally, without a handle of some sort, the combined weight of the plate filled with food and a beverage container within the beverage holder makes the apparatus both heavy and awkward to carry with one hand.

Prior art solutions have attempted to address these issues using a telescoping beverage holder configured similarly to a large collapsible cup. However, such collapsing configurations suffer from several problems that greatly diminish their usefulness for this purpose. First, most collapsing beverage holders utilize a number of conically shaped tapering sidewalls ("hollow frustums"), each successively decreasing in diameter. A hollow frustum of a cone (truncated cone) is a shape similar to a cylinder, except that the circular end planes are of unequal sizes and each of the circular end planes' center points are positioned directly above each other. This design creates a draft angle that requires the circular area of the top opening to be quite large in relation to the circular area required for the beverage container to rest flat on the floor of the bottom sidewall. Second, the various coupling mechanisms generally used for collapsible beverage holders are either (a) a friction fit between the two adjacent sidewalls, or (b) a flange on the top of one sidewall that fits over a ledge on the bottom of another sidewall. Each of these methods further increase the draft angle required for the sidewalls, and thus further increase the area of the top opening which decreases the stability of the beverage container while in the beverage holder. Third, the draft angle must be yet further increased for both methods in order to provide sufficient clearance between the frustums to prevent binding, catching, and locking up as the frustums are collapsed or un-collapsed, causing tilting of the bottom frustum. This is fatal to the desired function as it results in tilting the beverage container and spilling its contents as the plate is either lifted from or placed on a table.

Thus, prior art solutions in practice require a draft angle so large for acceptable functioning of their collapsible beverage holders that the beverage container can tilt and spill even within their collapsible holders, whether collapsed or un-collapsed. It also requires significantly more surface area of the plate be devoted to the telescoping beverage holder, thereby increasing the size, weight, and cost of the combined plate and beverage holder. Fourth, both coupling mechanisms, friction fit and flange, operate only as a limit to telescopic extension of the sidewalls. Neither coupling mechanism in practice prevents rotation of the sidewalls, which allows the plate to spin around the axis of the sidewalls, resulting in spilling both food and beverage. Fifth, neither coupling mechanism, friction fit or flange, prevents tilting of the sidewalls with respect to each other and the plate, thereby causing instability for both the plate and food as well as the beverage. The friction fit requires significant pressure to actually lock the sidewalls in place and can then be very difficult to dislodge in order to unlock and collapse the sidewall. The inherent design of the flanges either suffers from the same problem or is free to tilt with little interference. Sixth, both coupling mechanisms, friction fit and flange, operate only to prevent extension of the sidewalls beyond a specified point as they extend downward from the largest sidewall. However, when collapsing the sidewalls, there is no limiting constraint and the smaller sidewalls can separate from the larger sidewalls, coming completely apart and possibly lost.

SUMMARY

The present invention, as disclosed and described herein, in one aspect thereof, comprises a plate defining a surface for holding food that defines at least one opening therein. A collapsible beverage holder fits within the at least one opening defined within the surface of the plate. The collapsible beverage holder is automatically configured to a collapsed configuration responsive to the apparatus being placed on a surface and is automatically configured to an un-collapsed configuration responsive to the apparatus being lifted off the surface by the plate.

BRIEF DESCRIPTION OF THE DRAWINGS

For a more complete understanding, reference is now made to the following description taken in conjunction with the accompanying Drawings in which.

DETAILED DESCRIPTION

Figure 1:
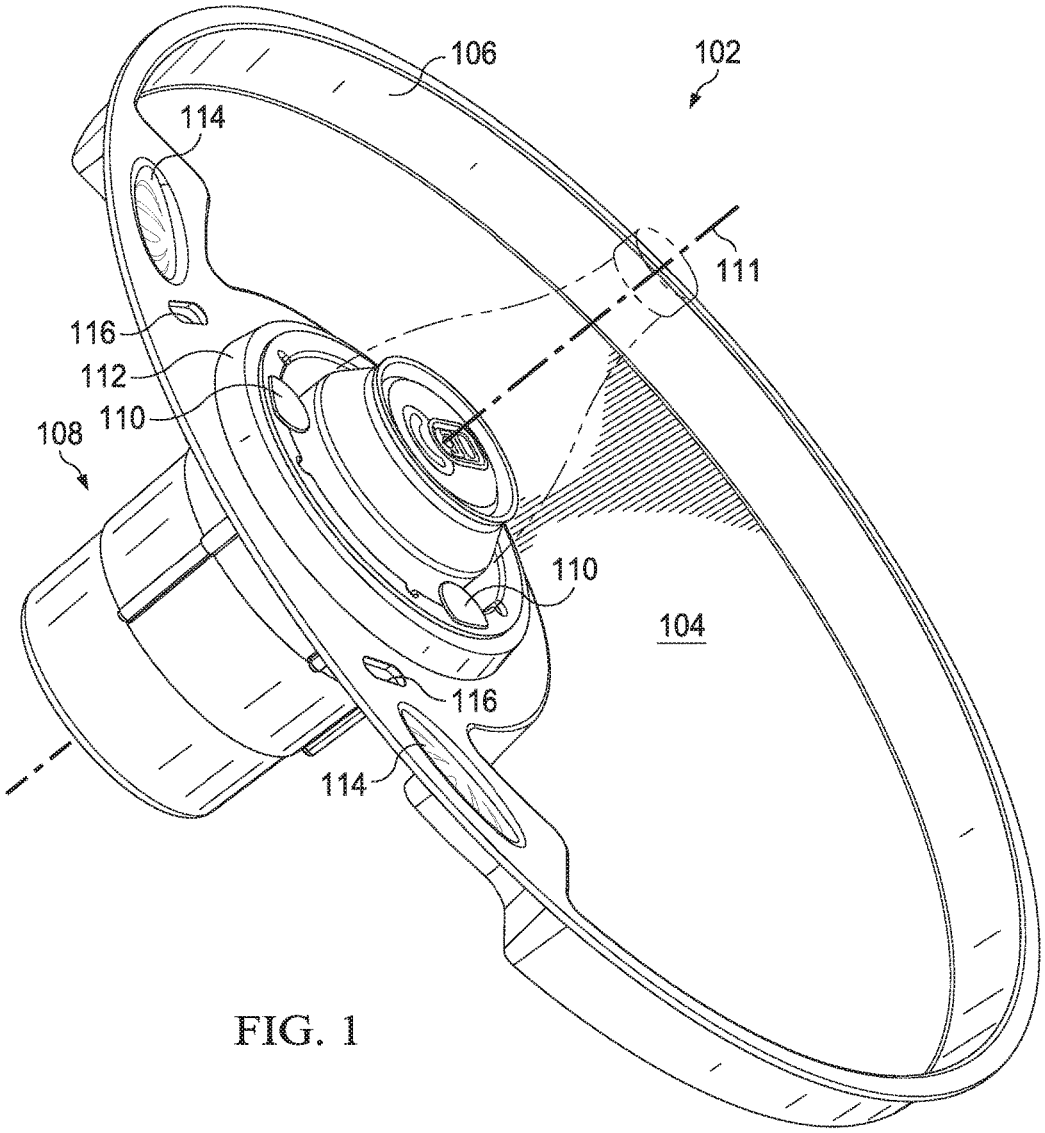
FIG. 1 is a perspective view of the top side of the plate with integrated beverage holder.

Referring now to the drawings, wherein like reference numbers are used herein to designate like elements throughout, the various views and embodiments of a combined plate and collapsible beverage holder are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
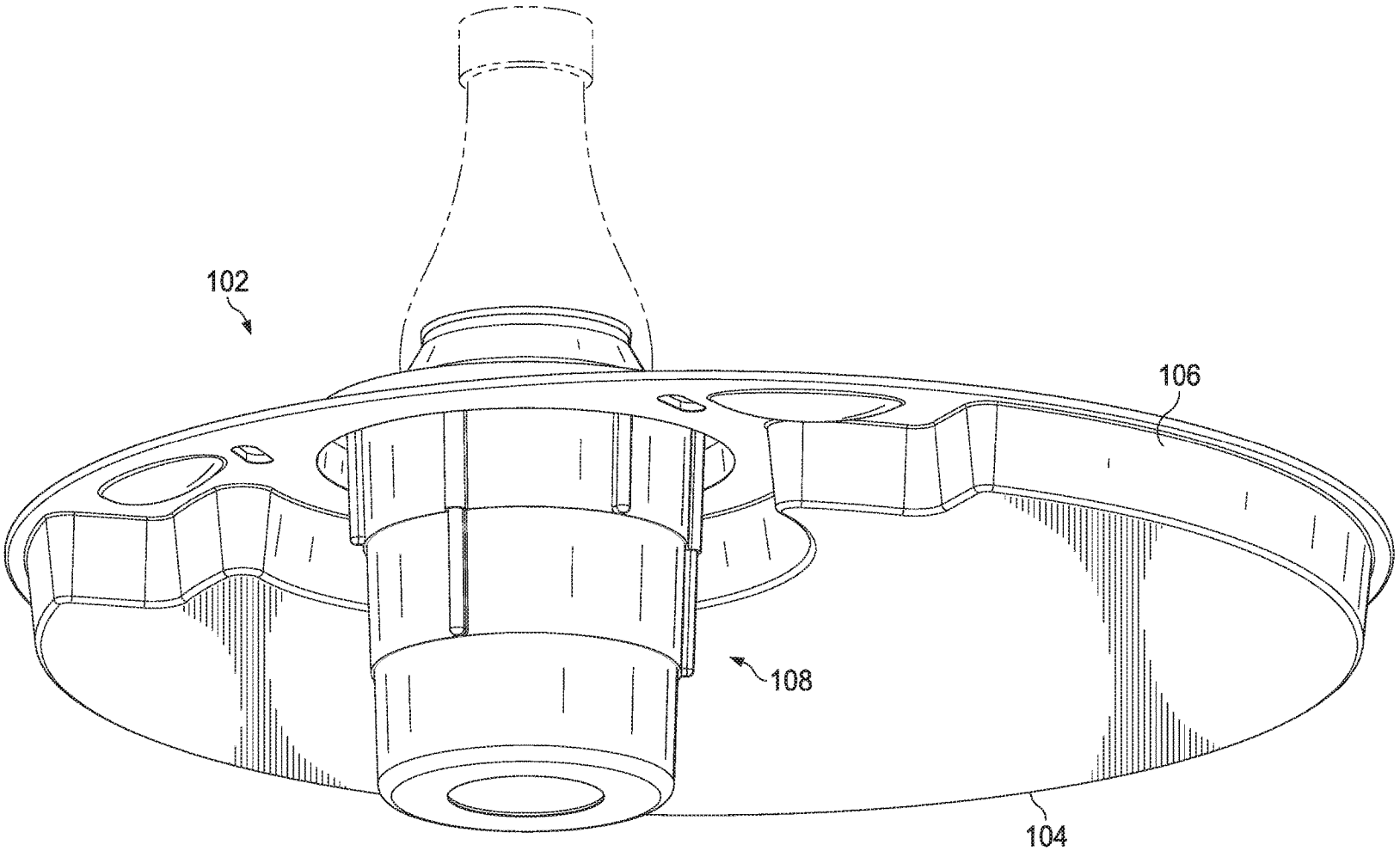
FIG. 2 is a perspective view of a bottom side of the plate with integrated beverage holder.

FIGS. 1 and 2 illustrate a top perspective view and a bottom perspective view of the plate and beverage holder device 102. The plate and beverage holder device 102 includes a plate component 104 including one or more compartments for holding food. A plate peripheral flange 106 surrounds the edge of the plate component 104 and maintains food within the plate compartment. While the illustrations of FIG. 1 and FIG. 2 illustrate only a single plate compartment, it will be appreciated that any number of food compartments may be utilized for separating and containing food within the plate component 104. The plate component 104 is of sufficient size to hold an appropriate amount of food with the plate peripheral flange 106 extending upward and outward from the outer rim to contain the food on the plate. In one embodiment, the plate component 104 may be 12 inches wide and the plate peripheral flange 106 may be 1 inch in height. In another embodiment, a plurality of thumb grips 114 are located on the periphery of the plate component 104 next to the aperture raised rim 112. They are knurled and indented to fit the thumb for secure, comfortable, and ergonomic lifting of the plate and beverage holder device 102. In yet another embodiment, the plate component 104 may include a plurality of vertically disposed utensil slots 116 where utensils can be inserted while serving and carried until required for use.

The shape and design of the plate component 104 may vary considerably as dictated by the intended market. For example, the plate component 104 may be of any shape, such as oval, rhomboid, rectangular, circle, square, triangle, etc. The plate peripheral flange 106 may be of any height, angle, or curved and its surface area could have any number of smaller segments with raised ridges similar to the plate peripheral flange 106 to separate various foods, dips, condiments, etc., within the interior surface area of the plate.

Figure 9:
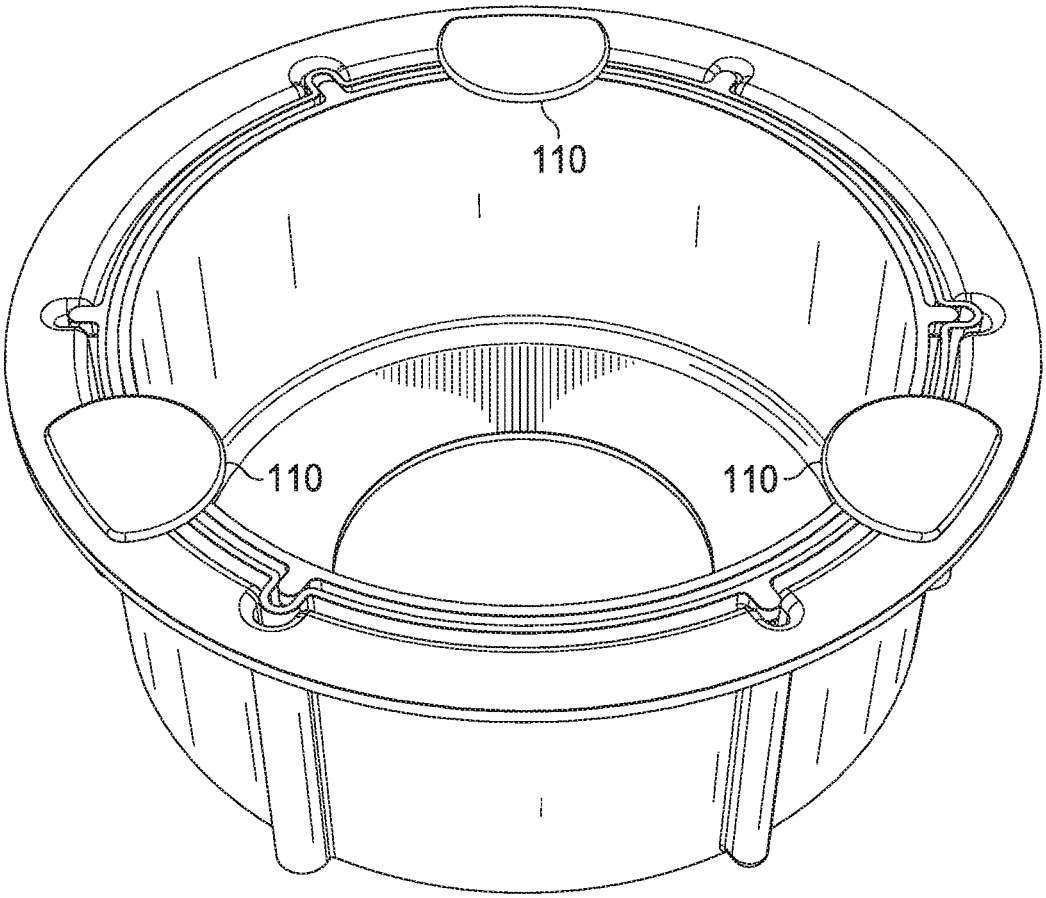
FIG. 9 illustrates a perspective view of the securing tabs within the collapsible beverage holder.

The plate and beverage holder device 102 may be made of plastic or any other sufficiently rigid and strong material such as high-strength plastic, paper board, metal, or the like. The plate and beverage holder device 102 can be manufactured by means of injection molding from various selected polymers to provide high strength and low weight with attractive colors while also making it microwave safe, dishwasher safe, food safe, and BPA free. A material with a smooth finish and low coefficient of friction is selected so that minimum friction is produced between the sidewalls of the beverage holder component 108 as it moves between collapsed and un-collapsed positions. The tabs 110 used to hold the beverage container 404 firmly in place can be in the form of three separate pieces or a singular circular ring with tabs 110 located approximately 120° apart as more particularly illustrated in FIG. 9. The tabs 110 are used for securing the can, bottle, or cup within the beverage holder component 108. The tabs 110 are made from a material that is durable, flexible, and has good compression set resistance (memory) in order to retain their position at right angles to the aperture raised rim 112 extending inward toward the longitudinal axis 111 of the beverage holder component 108. The position of the tabs 110 provides an upper limit to prevent the middle sidewall 504 and the base sidewall 506 from separating from the top sidewall 502. The tabs 110 provide three equidistant points of contact with the beverage container 404 to prevent it from tipping. The extended height of the beverage holder component 108 below the plate component 104 is sufficient to lower the center of gravity of the beverage container 404 placed within the beverage holder component 108, thereby increasing the stability of the beverage container 404 and eliminating the possibility of spilling the beverage.

A beverage holder component 108 moves between a first fully collapsed position and a second fully un-collapsed position for supporting a beverage container 404 such as a can, bottle, or cup along a longitudinal axis 111 through the center of the area for containing the beverage container 404. The beverage holder component 108 attaches to the plate component 104 using a locking mechanism, attachment with a band containing a bayonet or other locking mechanism, or other mating means so that the beverage holder component 108 can be easily removed for cleaning and storage and then replaced for a next use. In an alternative embodiment, the beverage holder component 108 may be integrated with the plate component 104 rather than being removable. The beverage holder component 108 is affixed to an aperture raised rim 112 in the plate component 104 and is of sufficient size to securely hold a wide variety of beverage containers 404, such as about 3.5 inches in diameter and about 4.5 inches in height when fully un-collapsed as the plate component 104 is lifted, and such as about 1.5 inches in height when fully collapsed when its base rests on the same surface plane as the bottom of the plate component 104.

Figure 3:
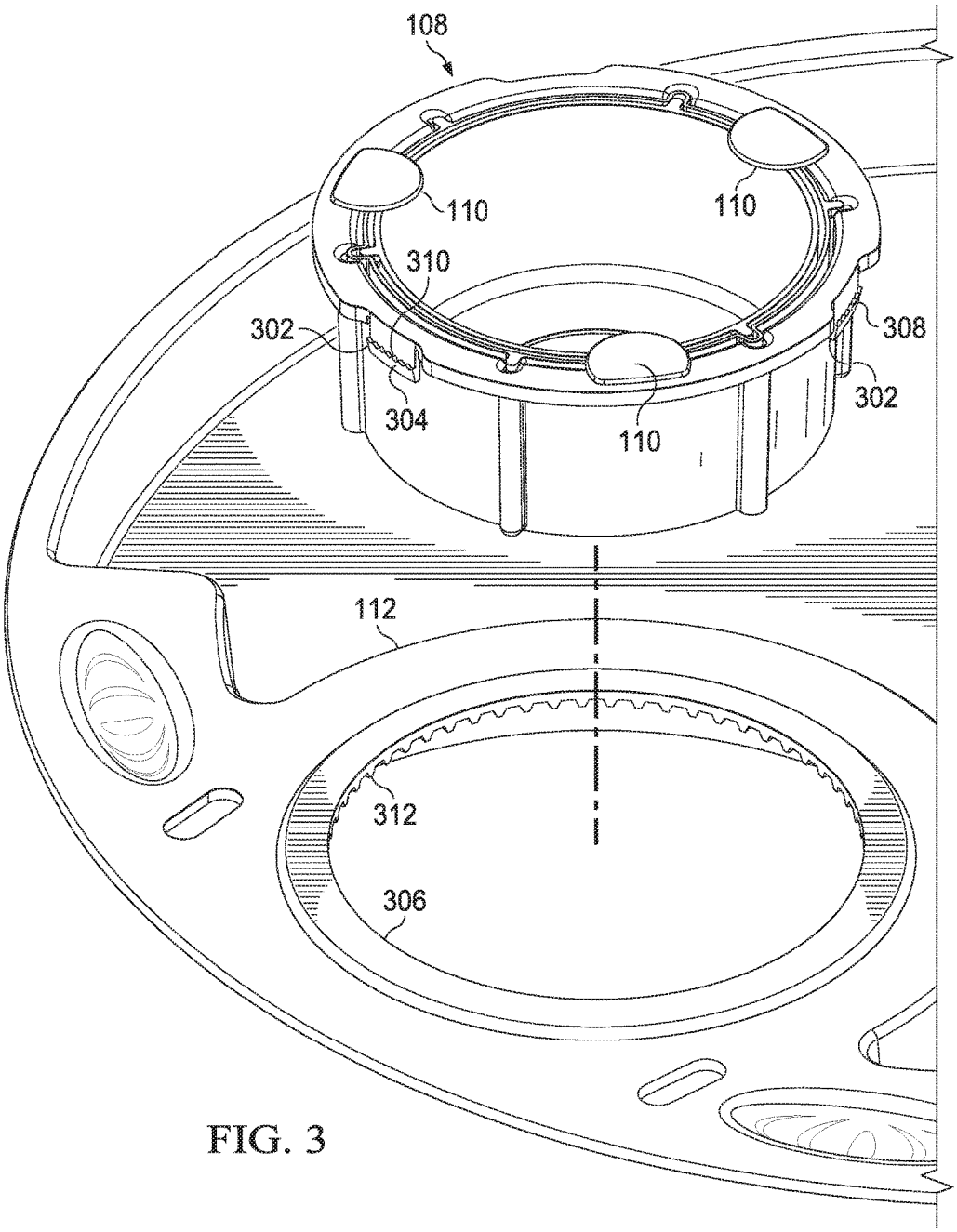
FIG. 3 illustrates a perspective view of an alternative embodiment of the collapsible beverage holder including snap tabs for securing the collapsible beverage holder to the plate.

In an alternative embodiment, such as that illustrated in FIG. 3, the beverage holder component 108 may be secured to the plate component 104 using a plurality of snap tabs 302. The snap tabs 302 include an angular surface 304 that causes the snap tab 302 to bend inward when pressed against an edge 306 of the aperture raised rim 112. A retaining ledge 308 engages the edge 306 of the raised rim 112 to prevent the beverage holder component 108 from being easily removed from the plate component 104. Additionally, teeth 310 on the snap tabs 302 engage teeth 312 on the bottom side of the edge 306 of the aperture raised rim 112 to serve as an anti-rotation element. When the teeth 310 of the beverage holder component 108 engage the teeth 312 of the aperture raised rim 112 of the plate component 104, the beverage holder component 108 is prevented from rotating in the aperture raised rim 112 and the plate component 104 is held in a fixed position.

Figure 4:
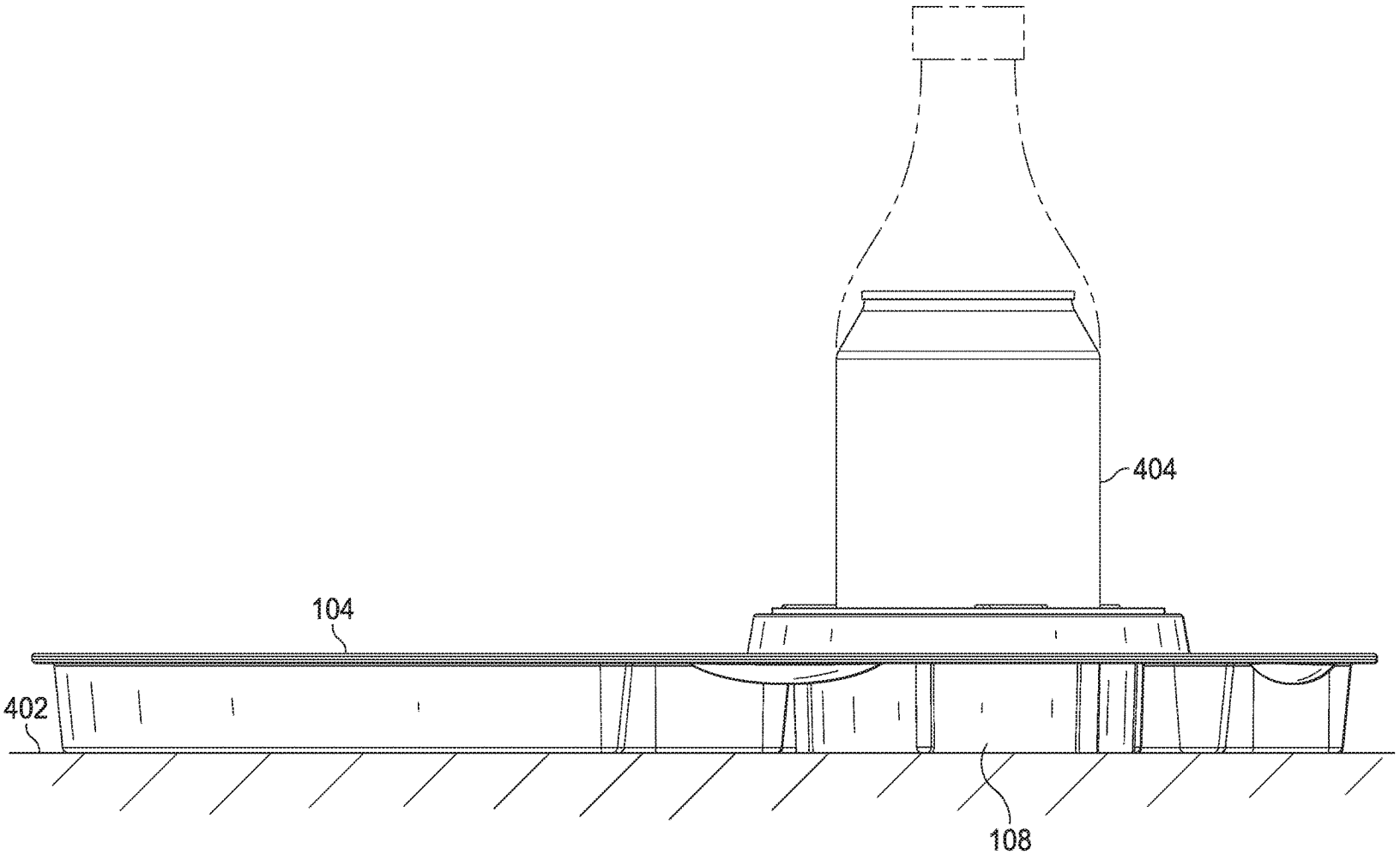
FIG. 4 illustrates a side view of the plate with integrated beverage holder in a collapsed position.

Referring now to FIG. 4, there is illustrated a side view of the plate component 104 and the beverage holder component 108 sitting on a surface 402 such as a table, counter, ledge, etc. When placed on a surface 402, the beverage holder component 108 automatically moves to the fully collapsed position such that the bottom of the beverage holder component 108 and the bottom of the plate component 104 are aligned on a single plane with each other. This allows the entire plate and beverage holder device 102 to be placed flat on a level surface 402 so that the beverage container 404 within the beverage holder component 108 is thus maintained in a stable position.

Figure 5:
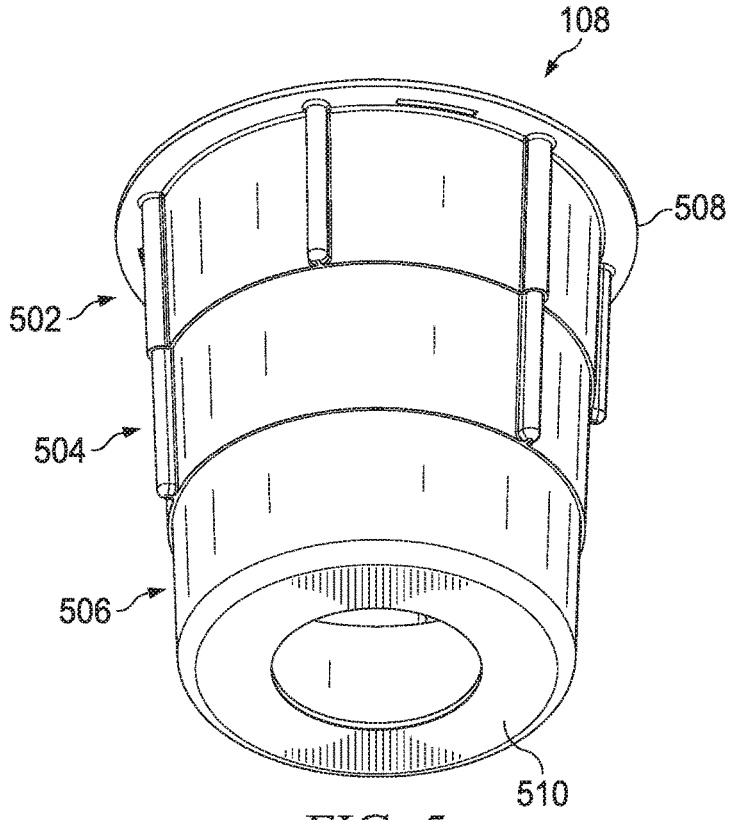
FIG. 5 illustrates a perspective view of the collapsible beverage holder.

Referring now to FIG. 5, there is illustrated a perspective view of only the beverage holder component 108 in the fully extended position. The fully extended position would be automatically configured when the beverage holder and plate device 102 is lifted from a surface 402 such as that illustrated in FIG. 4. The beverage holder component 108 is comprised of a number of collapsible hollow frustum sections 502-506 (hereinafter "sidewalls") having only a very slight draft required for an injection molding tool to eject the plastic sidewalls. A top sidewall 502 having a top sidewall rim 508 engages and affixes to the aperture raised rim 112 (FIG. 1) of the plate component 104. One or more middle sidewalls 504 interconnects the top sidewall 502 with a base sidewall 506. The base sidewall 506 defines a base ledge 510 for supporting the bottom of a beverage container 404. The size of the sidewalls from the top sidewall 502 to the base sidewall 506 successively decreases in diameter so as to enable the lower sidewalls to nest within the above sidewalls. The beverage holder component 108 may be manufactured separately from the plate component 104, assembled, and either attached permanently to the plate component 104 with a locking mechanism or attached with a snap-in locking element or other type of mount so that it can be easily removed for cleaning or storage and then replaced for a next use.

Figure 6:
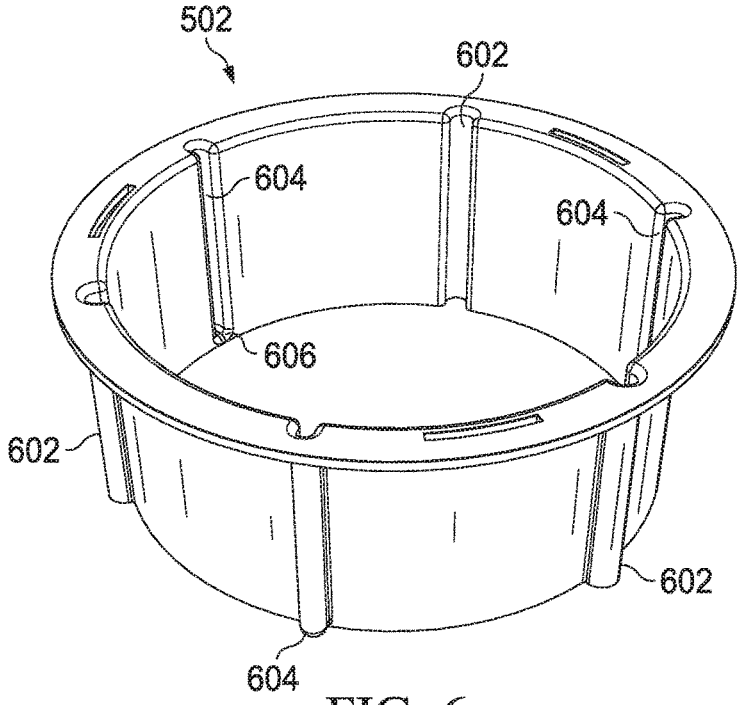
FIG. 6 illustrates a perspective view of a top sidewall.

Referring now to FIG. 6, there is illustrated a perspective view of the top sidewall 502. The top sidewall 502 defines a hollow frustum having an open center wherein the top edge has a slightly larger diameter than the bottom edge. The top sidewall 502 defines three vertical guide channels 602 located 120° apart from each other that extend vertically from the top of the top sidewall 502 to the bottom of the top sidewall 502 and protrude outward from the inside diameter of the top sidewall 502. The guide channels 602 may be cylindrical in nature but could also take on other shapes as well. The top sidewall 502 also includes three smaller stop channels 604 similar to the guide channels 602 running vertically along the top sidewall 502 except that the lower extension limit of the stop channel 604 has a base or floor 606 to create a stop for a pin associated with a middle sidewall 504. The guide channels 602 and stop channels 604 alternate and are located equidistant at 60° along the inside of the top sidewall 502.

Figure 7:
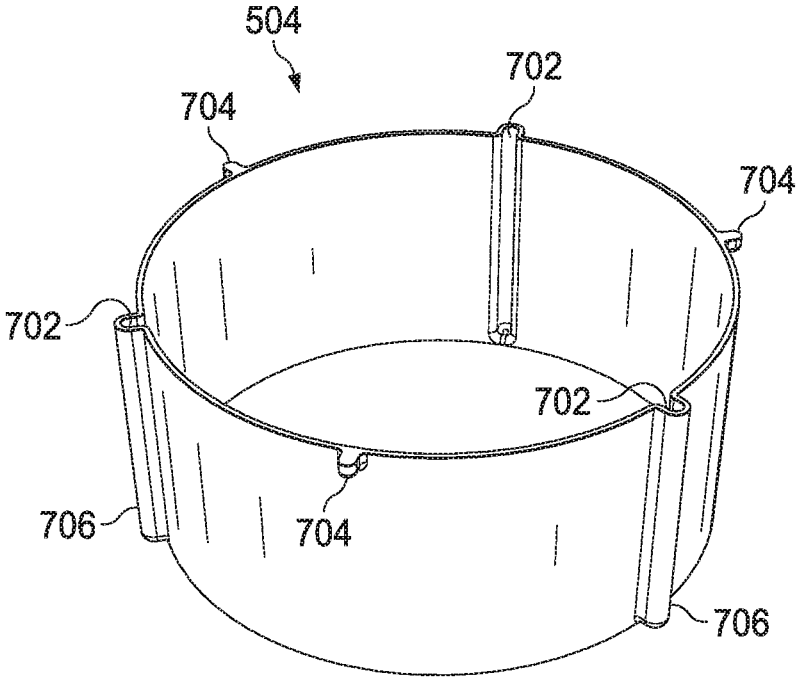
FIG. 7 illustrates a perspective view of a middle sidewall.

Referring now to FIG. 7, there is illustrated the middle sidewall 504. The middle sidewall 504 also defines a hollow frustum having an open center wherein the top edge has a slightly larger diameter than the bottom edge. The middle sidewall 504 defines three stop channels 702 and three pins 704 each located equidistant and alternating at 60° around the middle sidewall 504. The three stop channels 702 extend from a top edge of the middle sidewall 504 and have a bottom of the stop channels 702 defined by a base or floor 706. The stop channels 702 may be cylindrical in nature but may also take on other shapes as well. The stop channels 702 are located 120° apart from each other and protrude outward from the inside diameter of the middle sidewall 504. The stop channels 702 further create exterior guide members 706 on the exterior surface of the middle sidewall 504. The exterior guide members 706 have a horizontal cross-sectional area sufficiently smaller than the horizontal cross-sectional area of the guide channels 602 of the top sidewall 502 to allow the guide members 706 to slide effortlessly from the top of the top guide channel 602 to the bottom of the top guide channel 602. The three pins 704 extend outward from the outside diameter of the middle sidewall 504 with horizontal cross-sectional areas sufficiently smaller than the horizontal cross-sectional area of the stop channels 604 of the top sidewall 502 to allow the pins 704 to slide effortlessly from the top of the top sidewall 502 to the floor 606 of the stop channel 604 of the top sidewall 502. The contact with the floor 606 of the stop channel 604 provides a lower limit to the extension of the middle sidewall 504. While the present embodiment has described the use of only a single middle sidewall 504, multiple middle sidewalls 504 having a similar configuration may be utilized. In this case, the pins 704 of a second middle sidewall 504 would engage the stop channels 702 of the first middle sidewall 504 rather than the stop channels 604 of the top sidewall 502. Additional middle sidewalls 504 could be added in a similar manner.

Figure 8:
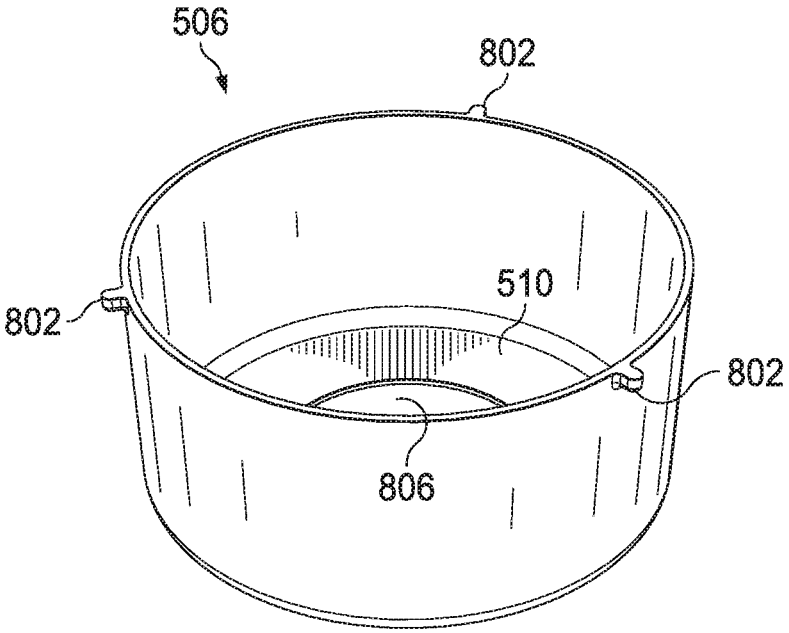
FIG. 8 illustrates a perspective view of a bottom sidewall.

Referring now to FIG. 8 there is illustrated the base sidewall 506. The base sidewall 506 defines a hollow frustum having an open center wherein the top edge has a slightly larger diameter than the bottom edge. The base sidewall 506 has no guide channels or stop channels. The base sidewall 506 only defines three pins 802 each located equidistant at 120° that extend outward from the outer diameter of the base sidewall 506. The pins 802 have a horizontal cross-sectional area sufficiently smaller than the horizontal cross-sectional area of the stop channels 702 of the middle sidewall 504 to allow the pins 802 to slide effortlessly from the top to the floor of the stop channel 702 of the middle sidewall 504. The base sidewall 506 further defines a base ledge 510. The base ledge 510 in one embodiment defines an aperture 806 therethrough although the aperture 806 may be of various diameters or nonexistent. The base ledge 510 must extend at approximately a right angle inward from the base edge of the base sidewall 506 a sufficient distance to allow a beverage container 404 to sit flat and securely thereon.

The external guide channels system defined by the beverage holder component 108, consisting of the guide channels, stop channels, guide members, and pins described above, permits the beverage holder component 108 to extend and collapse automatically without hanging, catching, interfering, or binding resulting in the spillage of a food or beverage. The external guide channel system enables the telescoping sidewalls to slide on the external guide channel system to collapse automatically as the plate is lowered onto a table so that the plate can rest flat and stably. When the apparatus is lifted, the telescopic beverage holder component 108 automatically extends downward to provide additional stability for the beverage container 404 while in motion and to allow the user to grasp the beverage holder component 108 with either hand while resting the plate on the forearm of the grasping hand. This provides additional stability and convenience while holding the plate.

The design of the external guide channel system also provides additional functions and benefits. First, the external guide channels provide vertical grips to enable the fingers of a user to grasp the beverage holder component 108 more securely. When a user grasps the fully extended beverage holder component 108, the vertical guide channels, guide members, and pins sliding therein operate to lock the sidewalls in a vertically aligned position. This is necessary to prevent them from twisting sideways in a circular manner parallel to the plate. Without locking the sidewalls in a vertically aligned position relative to the plate, if the plate were to tilt for any reason, the plate could spin off the forearm and spill the contents. Second, the guide members travelling vertically and in close tolerance to the guide channels greatly decreases the amount of tilt that is possible between the sidewalls when fully extended. Third, the extended beverage holder component 108 enables the user to grasp it with a single hand around the extended beverage holder component 108, thereby freeing the other hand to eat food, open doors, drink the beverage, carry eating utensils, or greet and shake hands with other individuals.

Many features incorporated into the design of the beverage holder component 108 operate together to collectively reduce the draft angle required. This produces numerous benefits to its basic function—collapsing and un-collapsing flawlessly. It reduces the diameter of the top of the top sidewall 502 relative to the diameter of the base ledge 510 which must be large enough to allow standard beverage containers to rest flat on its surface. This more upright draft angle provides a tighter fit at the top to insure the beverage container 404 remains stable and upright on its base. Reducing the top diameter of the top sidewall 502 also decreases the diameter of the aperture raised rim 112 which results in more usable area for serving food on the plate 104 and also in a smaller total area for the combined plate and beverage holder device 102 that reduces the size, weight, and cost. The design also allows it to securely hold most common beverage containers 404 including cans, bottles, cups, and stemware. The design further enables it to hold many different shapes and sizes of containers such as square or elliptical bases with vertical container walls. Many other beverage holders are limited to round bases and conical shaped containers.

The beverage holder component 108 slides open on the external guide channel system to extend automatically using only gravity's pull when the plate 104 is lifted. Additionally, the beverage holder component 108 slides on the external guide channels to collapse automatically as the plate 104 is lowered onto a table or another horizontal surface 402. The automatic adjustment of the telescopic beverage holder component 108 provides a number of advantages. It eliminates the necessity for legs to raise the plate 104 height to offset the height of the un-collapsed length of the beverage holder component 108 extending three or more inches below the bottom of the plate 104. The automatic adjustment also allows the beverage holder component 108 to expand to a lower and more secure position to prevent spillage when the plate is not placed on a table such as when a user is walking or standing and eating. When the beverage holder component 108 is collapsed, the automatic adjustment feature also provides a profile height only slightly greater than the plate 104 height in order to decrease the volume required for placement in a cabinet, drawer, or dishwasher. The assembled plate and beverage holder device 102 nests and stacks easily to conserve storage space, even more so with the beverage holder component 108 removed.

Inexpensive disposable inserts that take the form of and fit within the interior portion of the plate 104 can also be used to contain the food and prevent the food from direct contact with the plate 104. The inserts may be made of paper, plastic, plastic film, or other material that could be either a single or multiuse application. The inserts could also be produced from recyclable plastic or with a biodegradable material. This provides several environmentally friendly options such as using the plate and beverage holder device 102 alone and washing it for reuse or using an insert that can be washed and reused, properly disposed of, or recycled at the user's discretion. The inserts may be configured with various partitions designed for different items such as a bowl with higher sides for soups, cereals, or other liquids, smaller partitions for dips or condiments, raised slots to hold tacos, or any other configuration that enhances the service of a particular type of meal. The inserts may also be transparent and include advertising, licensed college or sports logos, etc., or any other wording, decoration, or pictures such as for a birthday party or other special celebration (collectively "decorations") with the design affixed to the bottom of the insert facing upwards to prevent scratching from eating utensils or contact with food. Likewise, such decorations could also be affixed directly to the underside of a transparent plate 104. Decorations could also be affixed to the top eating surface of the insert or plate if they were durable and safe for direct food contact. This would obviate the requirement for a transparent plate 104 or insert and the plate 104 could therefore be any color or combination of colors.

Various types of covers may also be used with the plate component 104 to prevent food splattering while microwaving, to keep food warm by heat retention, for storage in the refrigerator, and to protect the food from dirt, insects, etc., after it is placed on the plate but before eating. Such covers may be made of many different plastics to match the desired effects of the cover. Further, the cover can be made from any colored, transparent, or translucent plastic material. The covers may also be made in various thicknesses and styles to provide a desired effect. The cover materials may comprise flexible plastic with edges that snap over the side of the plate component 104 or they may be made in a more rigid plastic with the edge designed to sit on and/or fit over the peripheral upper rim of the plate component 104.

It will be appreciated by one skilled in the art that the quantity and dimensions of the sidewalls, guide channels, stop channels, and pins work in any number of configurations that may be optimized to allow the sidewalls to slide effortlessly without binding in any manner. Additionally, it should be appreciated that the various sizes and shapes of the plate component 104 as well as the various locations of the aperture to receive the beverage holder component 108 can vary in any combination that provides a functional device.

It will be appreciated by those skilled in the art having the benefit of this disclosure that this combined plate and collapsible beverage holder device provides a superior plate and drink holder combination for use at parties and events, either indoors or outdoors, where people are moving around rather than being at a single seating location. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An apparatus comprising:

a plate defining a surface for holding food, the surface defining at least one opening therein; and a collapsible beverage holder that fits within the at least one opening defined within the surface of the plate, the collapsible beverage holder moving between a collapsed configuration responsive to the apparatus being placed on a surface and an un-collapsed configuration responsive to the apparatus being lifted off the surface by the plate, wherein the collapsible beverage holder further comprises:

a top tubular body for connecting to an edge of the at least one opening defined within the surface of the plate, the top tubular body having a first body wall with a first exterior surface and a first interior surface defining a first passageway therein, the first body wall defining a plurality of top guide channels having a first cross-sectional area extending longitudinally along the first interior surface from a top end of the top tubular body to a bottom end of the top tubular body, the first body wall further defining a plurality of top stop channels, each of the top stop channels located between a pair of the top guide channels, extending longitudinally along the first interior surface from the top end of the top tubular body to a stop ledge within the top tubular body;

at least one middle tubular body having a second body wall with a second exterior surface and a second interior surface defining a second passageway therein, the second body wall defining a plurality of middle stop channels extending longitudinally along the first interior surface from a top end of the middle tubular body to a bottom end of the middle tubular body, the plurality of equally spaced middle stop channels further defined by a guide member running longitudinally along the second exterior surface of the second body wall for sliding within the top guide channels, the second body wall further defining a plurality of middle guide pins for sliding within the first stop channels, the guide member sliding within the top guide channel and the middle guide pins sliding within the top stop channels between the collapsed configuration and the un-collapsed configuration;

a bottom tubular body having a third body wall with a third exterior surface and a third interior surface defining a third passageway therein, the third body wall further defining a plurality of bottom guide pins for sliding within the middle stop channels of the at least one middle tubular body between the collapsed configuration and the un-collapsed configuration; and a base support extending from the bottom end of the bottom tubular body to support a container placed in the collapsible beverage holder.

2. The apparatus of claim 1, wherein the collapsible beverage holder further comprises:

top tubular body has a top end of a first diameter and a bottom end of a second diameter smaller than the first diameter;

wherein the at least one middle tubular body has a top end of a third diameter smaller than the second diameter and a bottom end of a fourth diameter smaller than the third diameter; and wherein the bottom tubular body has a top end of a fifth diameter smaller than the fourth diameter and a bottom end of a sixth diameter smaller than the fifth diameter.

3. The apparatus of claim 1, wherein the plate further defines a raised edge surrounding the at least one opening.

4. The apparatus of claim 1 further comprising a plurality of flexible tabs extending from a top edge of the collapsible beverage holder for securing a container within the collapsible beverage holder.

5. The apparatus of claim 1, wherein the collapsible beverage holder is secured to an edge of the at least one opening defined within the plate.

6. The apparatus of claim 5 further including a plurality of flexible latching tabs for securing the collapsible beverage holder to the edge of the at least one opening, the flexible latching tab further comprising:

at least one locking member for engaging the edge of the at least one opening to removeably secure the collapsible beverage holder to the plate;

a flexible member interconnecting the at least one locking member to the collapsible beverage holder; and wherein the flexible member enables the at least one locking member to be moved between a first position for inserting and removing the collapsible beverage holder from the plate and a second position for securing the collapsible beverage holder to the plate.

7. The apparatus of claim 6 further including:

a first plurality of teeth defined on the at least one locking member;

a second plurality of teeth associated with the edge of the at least one opening defined on the plate; and wherein the first plurality of teeth engages the second plurality of teeth when the collapsible beverage holder is connected to the plate and prevent the collapsible beverage holder from rotating within the at least one opening.

8. An apparatus comprising:

a plate defining a surface for holding food, the surface defining at least one opening therein;

a collapsible beverage holder that fits within the at least one opening defined within the surface of the plate, wherein the collapsible beverage holder further comprises:

a top tubular body for connecting to an edge of the at least one opening defined within the surface of the plate, wherein the top tubular body has a first body wall with a first exterior surface and a first interior surface defining a first passageway therein, the first body wall defining a plurality of top guide channels having a first cross-sectional area extending longitudinally along the first interior surface from the top end of the top tubular body to the bottom end of the top tubular body, the first body wall further defining a plurality of top stop channels, each of the top stop channels located between a pair of the top guide channels, extending longitudinally along the first interior surface from the top end of the top tubular body to a stop ledge within the top tubular body;

a bottom tubular body for supporting a beverage container placed within the collapsible beverage holder;

at least one middle tubular body for connecting the top tubular body with the bottom tubular body;

wherein the bottom tubular body telescopically collapses within the at least one middle tubular body and the at least one middle tubular body telescopically collapses into the top tubular body;

further wherein the top tubular body, the at least one middle tubular body, and the bottom tubular body move between a collapsed configuration responsive to the apparatus being placed on a surface and an un-collapsed configuration responsive to the apparatus being lifted off the surface by the plate.

9. The apparatus of claim 8, wherein the top tubular body has a top end of a first diameter and a bottom end of a second diameter smaller than the first diameter.

10. The apparatus of claim 8, wherein the at least one middle tubular body has a second body wall with a second exterior surface and a second interior surface defining a second passageway therein, the at least one middle tubular body having a top end of a third diameter smaller than the second diameter and a bottom end of a fourth diameter smaller than the third diameter, the second body wall defining a plurality of equally spaced middle stop channels extending longitudinally along the first interior surface from the top end of the top tubular body to the bottom end of the top tubular body, the plurality of equally spaced middle stop channels further defined by a guide member running longitudinally along the second exterior surface of the second body wall for sliding within the top guide channels, the second body wall further defining a plurality of guide pins for sliding within the first stop channels, the guide member sliding within the top guide channel and the middle guide pins sliding within the top stop channels between the collapsed configuration and the un-collapsed configuration.

11. The apparatus of claim 8 further comprising:

wherein the bottom tubular body has a top end of a fifth diameter smaller than the fourth diameter and a bottom end of a sixth diameter smaller than the fifth diameter, the second body wall further defining a plurality of bottom guide pins for sliding within the middle stop channels of the at least one middle tubular body, the bottom guide pins sliding within the middle stop channels between the collapsed configuration and the un-collapsed configuration; and a base support extending from the bottom end of the bottom tubular body to support a container placed in the collapsible beverage holder.

12. The apparatus of claim 8, wherein the plate further defines a raised edge surrounding the at least one opening.

13. The apparatus of claim 8 further comprising a plurality of flexible tabs extending from a top edge of the collapsible beverage holder for securing a container within the collapsible beverage holder.

14. The apparatus of claim 8, wherein the collapsible beverage holder is secured to an edge of the at least one opening defined within the plate.

15. The apparatus of claim 14 further including a plurality of flexible latching tabs for securing the collapsible beverage holder to the edge of the at least one opening, the flexible latching tab further comprising:

at least one locking member for engaging the edge of the at least one opening to removeably secure the collapsible beverage holder to the plate;

a flexible member interconnecting the at least one locking member to the collapsible beverage holder; and wherein the flexible member enables the at least one locking member to be moved between a first position for inserting and removing the collapsible beverage holder from the plate and a second position for securing the collapsible beverage holder to the plate.

16. The apparatus of claim 15 further including:

a first plurality of teeth defined on the at least one locking member;

a second plurality of teeth associated with the edge of the at least one opening defined on the plate; and wherein the first plurality of teeth engages the second plurality of teeth when the collapsible beverage holder is connected to the plate and prevent the collapsible beverage holder from rotating within the at least one opening.

17. An apparatus comprising:

a plate defining a surface for holding food, the surface defining at least one opening therein;

a collapsible beverage holder that fits within the at least one opening defined within the surface of the plate, wherein the collapsible beverage holder further comprises:

a top tubular body for connecting to an edge of the at least one opening defined within the surface of the plate, the top tubular body having a first body wall with a first exterior surface and a first interior surface defining a first passageway therein, the top tubular body having a top end of a first diameter and a bottom end of a second diameter smaller than the first diameter, the first body wall defining a plurality of equally spaced top guide channels having a first cross-sectional area extending longitudinally along the first interior surface from the top end of the top tubular body to the bottom end of the top tubular body, the first body wall further defining a plurality of top stop channels, each of the top stop channels located between a pair of the top guide channels, extending longitudinally along the first interior surface from the top end of the top tubular body to a stop ledge within the top tubular body;

at least one middle tubular body having a second body wall with a second exterior surface and a second interior surface defining a second passageway therein, the at least one middle tubular body having a top end of a third diameter smaller than the second diameter and a bottom end of a fourth diameter smaller than the third diameter, the second body wall defining a plurality of equally spaced middle stop channels extending longitudinally along the first interior surface from the top end of the top tubular body to the bottom end of the top tubular body, each of the plurality of equally spaced middle stop channels further defined by a guide member running longitudinally along the second exterior surface of the second body wall for sliding within the top guide channel, the second body wall further defining a plurality of middle guide pins for sliding within the top stop channels, the guide member sliding within the top guide channel and the middle guide pins sliding within the top stop channels between the collapsed configuration and the un-collapsed configuration;

a bottom tubular body having a third body wall with a third exterior surface and a third interior surface defining a third passageway therein, the bottom tubular body having a top end of a fifth diameter smaller than the fourth diameter and a bottom end of a sixth diameter smaller than the fifth diameter, the third body wall further defining a plurality of bottom guide pins for sliding within the middle stop channels of the at least one middle tubular body, the bottom guide pins sliding within the middle stop channels between the collapsed configuration and the un-collapsed configuration; and a base support extending from the bottom end of the bottom tubular body to support a container placed in the collapsible beverage holder;

a plurality of flexible latching tabs for securing the collapsible beverage holder to the edge of the at least one opening, the flexible latching tab further comprising:

at least one locking member for engaging the edge of the at least one opening to removeably secure the collapsible beverage container to the plate;

a flexible member interconnecting the at least one locking member to the collapsible beverage holder; and wherein the flexible member enables the at least one locking member to be moved between a first position for inserting and removing the collapsible beverage holder from the plate and a second position for securing the collapsible beverage holder to the plate.

18. The apparatus of claim 17, wherein the plate further defines a raised edge surrounding the at least one opening.

19. The apparatus of claim 17 further comprising a plurality of flexible tabs extending from a top edge of the collapsible beverage holder for stabilizing and securing a beverage container within the collapsible beverage holder.

20. The apparatus of claim 17, wherein the collapsible beverage holder is secured to an edge of the at least one opening defined within the plate.

21. The apparatus of claim 17 further including:

a first plurality of teeth defined on the at least one locking member;

a second plurality of teeth associated with the edge of the at least one opening defined on the plate; and wherein the first plurality of teeth engages the second plurality of teeth when the collapsible beverage holder is connected to the plate and prevent the collapsible beverage holder from rotating within the at least one opening.

* * * * *